United States Patent [19]

Noé et al.

[11] Patent Number: 4,955,553

[45] Date of Patent: Sep. 11, 1990

[54] COILING REEL

[75] Inventors: Oskar Noé; Rolf Noé; Andreas Noé; Herbert Lux, all of Mülheim, Fed. Rep. of Germany

[73] Assignee: BWG Bergwerk- und Walzwerk-Maschinenbau GmbH, Duisberg, Fed. Rep. of Germany

[21] Appl. No.: 393,587

[22] Filed: Aug. 14, 1989

[30] Foreign Application Priority Data

Aug. 12, 1988 [DE] Fed. Rep. of Germany ..... 3827429

[51] Int. Cl.[5] ..... B65H 75/24

[52] U.S. Cl. ..... 242/63; 242/72.1

[58] Field of Search ..... 242/63, 72.1, 72 B, 242/72 R, 56.2, 56.9, 78.1

[56] References Cited

U.S. PATENT DOCUMENTS

| | | | |
|---|---|---|---|
| 4,352,470 | 10/1982 | Blakeslee | 242/72.1 |
| 4,421,283 | 12/1983 | Rippin | 242/63 X |
| 4,447,016 | 5/1984 | Enberg et al. | 242/56.9 |

*Primary Examiner*—John M. Jillions

*Attorney, Agent, or Firm*—Toren, McGeady & Associates

[57] ABSTRACT

A reel for coiling and uncoiling metal strips includes an expanding mandrel which is actuated by a spreader cylinder. The expanding mandrel is driven by a drive motor with a control and computing unit for determining the outer diameter of the coil at any given time. The outer diameter is introduced into a microprocessor which determines the initial spreading pressure and the winding pull to be maintained. The winding pull to be maintained is introduced into the control and computing unit. The microprocessor further determines, in dependence on the outer diameter of the coil, the required spreading pressure which is generated in the spreading cyclinder. As a result, the expanding mandrel always operates with a spreading force which is dependent upon the outer diameter of the coil at any given time, so that overloading is eliminated and wear is substantially reduced.

3 Claims, 2 Drawing Sheets

COILING REEL

BACKGROUND OF THE INVENTION

1. Field of the Invention

The present invention relates to a reel for coiling and uncoiling strips, particularly metal strips. The reel includes an expanding mandrel for the coil to be received. The expanding mandrel has at least shell-like spreading members, a spreader rod and spreading elements arranged between the spreading members and the spreader rod. A spreader cylinder is connected to the spreader rod and the expanding mandrel is driven by a drive motor with a control and computer unit for maintaining a predetermined winding pull or winding tension and for determining the outer diameter of the coil at any given moment.

2. Description of the Related Art

Reels of the above-described type are subjected to extremely high loads. In addition to the substantial weight of the coils of up to 45 tons in the case of steel coils, high winding pulls must be transmitted through the expanding mandrel to the respective coil. The spreading forces required for this purpose are generated by the spreader cylinder which is usually hydraulically operated. The spreader cylinder is rigidly connected to a mandrel shaft which surrounds the spreader rod. This spreader cylinder is operated by means of a pressure supply system with a feed pump.

The spreader cylinder and the spreading pressure are normally designed in such a way that a maximum coil with maximum coil weight can be coiled with maximum winding pull. In addition, the spreading pressure remains constant over the outer diameter of the coil at any given time. The winding pull is adjusted through the torque of the drive motor and is controlled in dependence on the outer diameter of the coil. The spreading forces which are inevitably also constant and relatively high when the spreading pressure is constant result in a significant wear of the spreading members and the spreading elements. Therefore, it is necessary to continuously check the reels and to disassemble the reels within relatively short intervals in order to replace the worn spreading components. Such a maintenance and repair of the reels is extremely time-consuming and expensive. In addition, due to the continuous maintenance of the maximum spreading pressure, for example, during uncoiling of a coil, the residual windings are damaged by afterspreading of the expanding mandrel and become useless.

When a strip is being coiled, an elastic winding pull is applied to the strip. As a result, radial forces act on the spreading members and the spreading elements. These radial forces continuously increase from winding to winding. The sum of these radial forces is particularly extremely high in those cases when thin and oiled or highly elastic metal strip, for example, aluminum strip is coiled. Although a self-supporting coiled ring is formed with increasing coil diameter, the high radial forces also lead to great wear or even failure of the spreading mechanism and subsequently to a collapse of the entire coil.

It is, therefore, the primary object of the present invention to provide a reel of the above-described type in which the service life of the expanding mandrel is substantially increased while avoiding premature wear and overloading.

SUMMARY OF THE INVENTION

In accordance with the present invention, in a coiling reel of the above-described type, the control and computing unit includes a microprocessor for determining at least the initial spreading pressure for the expanding mandrel and the winding pulls to be maintained in dependence upon introduced parameters which are specific to the strip being coiled. The microprocessor introduces the winding pull into the control and computing unit and receives from the control and computing unit the outer diameter of the coil at any given time and determines the spreading pressure required at any given time in dependence upon the outer diameter of the coil. The spreading pressure in the spreading cylinder is continuously readjusted by means of a pressure regulating valve controlled by the microprocessor, such that the spreading pressure in the spreading cylinder is the same as the spreading pressure continuously determined by the microprocessor.

Thus, in accordance with the present invention, the microprocessor determines the spreading force required for the coil or the spreading pressure required for the expanding mandrel. The spreading force for the coil or the spreading pressure for the expanding mandrel is controlled while taking into consideration the fact that the outer diameter of the coil continuously changes during the coiling process. Consequently, the spreading force or spreading pressure is continuously adjusted to the respective outer diameter of the coil, so that excess loads on the expanding mandrel are eliminated and the wear of the spreading components is substantially reduced.

For determining the initial spreading pressure for the expanding mandrel or the spreading force to be transmitted from the expanding mandrel to the coil, parameters which are specific to the strip are introduced into the microprocessor. These parameters are, for example, the weight of the coil, the width and the thickness of the strip, the specific winding pull, possibly the specific weight of the strip and an additional safety factor. This is because the spreading force on the expanding mandrel and, consequently, the spreading pressure required for the expanding mandrel, can be determined from the respective coil weight and also from the respective winding pull, wherein, in the first case, the spreading mechanism for converting the spreading pressure to the spreading force has to be taken into consideration and, in the latter case, the specific winding pull, the strip width, the strip thickness and the respective outer diameter of the strip must be taken into consideration.

Within the scope of the present invention, the winding pull is usually maintained constant by means of the control and computing unit for the drive motor. In that case, a permanent torque control takes place. However, it is essentially also possible to operate within certain limits with variable winding pulls over the outer diameter of the coil, for example, in order to coil a hard core of windings. In that case, a relatively high specific winding pull is employed. The hard core of windings then absorbs the subsequent radial forces when the diameter of the coil increases. As a result, less load is applied overall to the expanding mandrel during the coiling of strip and particularly of metal strip. The specific winding pull depends essentially on the thickness of the strip, the surface of the strip (dry, oiled, etc.) and the waviness of the strip to be coiled.

In accordance with an important feature of the present invention, after introducing or determining the initial outer diameter of the coil, the starting torque for the drive motor is determined by the microprocessor in dependence upon the specific winding pull and is transmitted to the control and computing unit for the drive motor. As a result, the starting torque of the drive motor corresponds to the respective outer diameter of the coil, i.e., the starting torque is equal to or only slightly greater than the torque to be applied on the expanding mandrel. Consequently, the drive motor does not have to operate with a starting torque which basically is provided for a maximum coil with maximum weight for winding with maximum winding pull. By adjusting the starting torque to the torque to be applied on the expanding mandrel, a further reduction of the spreading force in dependence upon the respective coil is achieved.

In accordance with a further feature of the present invention, a pressure-controlled spraying valve is arranged in the pressure line leading to the spreading cylinder following the pressure regulating valve. This spraying valve is connected to the return line of the pressure supply system and, thus, facilitates during the controlling of the spreading pressure corresponding to the spreading force to be applied the ejection of the pressure medium, just as the pressure regulating valve regulates in a similar manner the supply of pressure medium to the spreading cylinder and is controlled for this purpose by the microprocessor.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
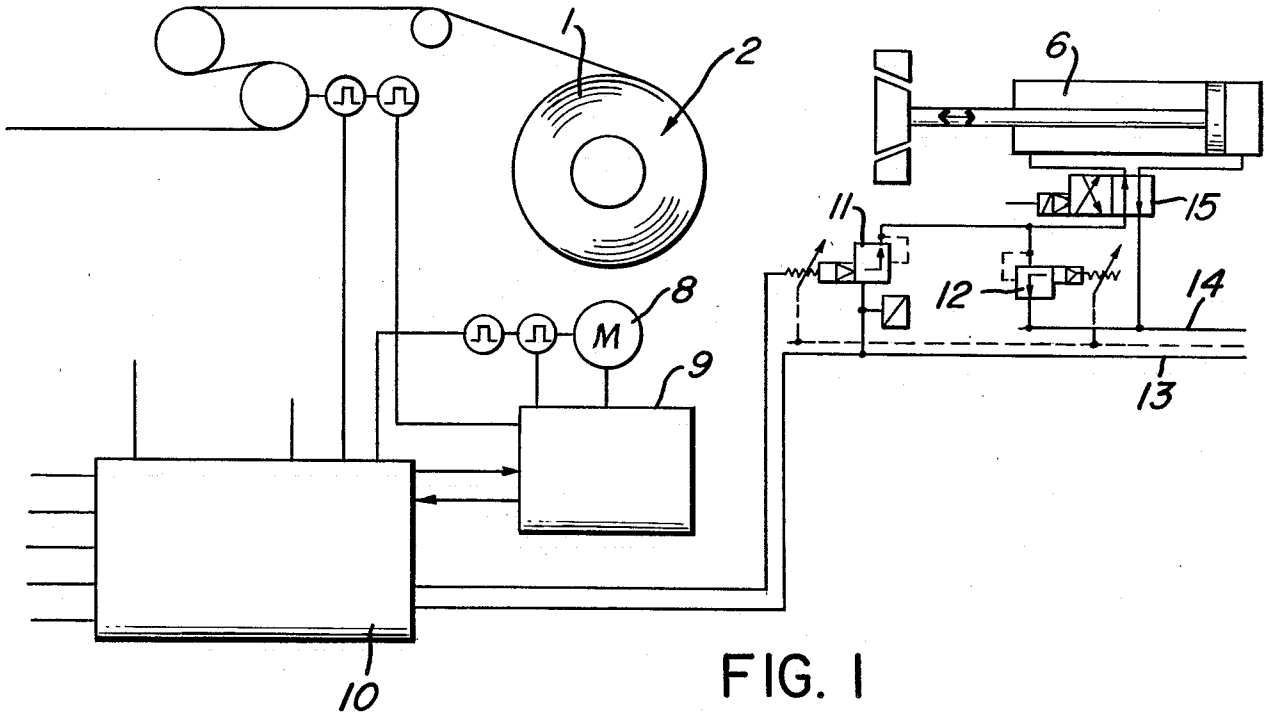
FIG. 1 is a schematic illustration of a coiling reel according to the present invention.
Figure 2:
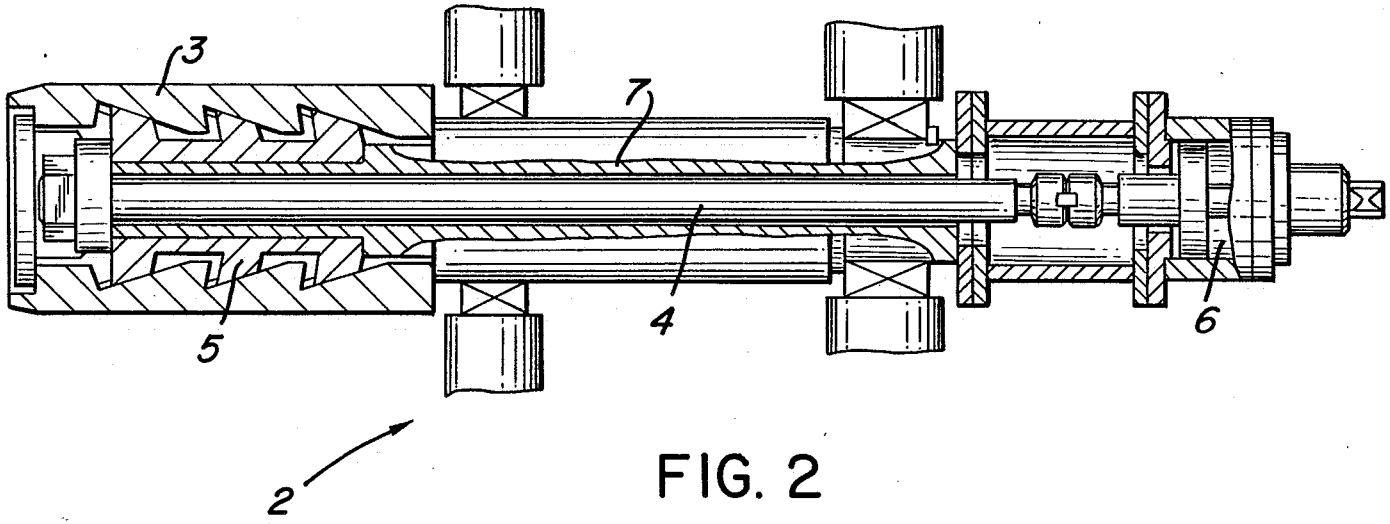
FIG. 2 is a schematic sectional view of an expanding mandrel with spreading cylinder of the reel of FIG. 1.

The figures of the drawing show a reel for coiling and uncoiling strips, particularly metal strips. The reel includes an expanding mandrel 2 for the coil 1 to be received. The expanding mandrel 2 includes at least shell-like spreading members 3, a spreader rod 4 and spreading elements 5 arranged between the spreading members 3 and the spreader rod 4. In the illustrated embodiment, the spreading elements are spreading wedges or wedge-type ledges. A spreading cylinder 6 is coaxially connected to the spreader rod 4. The spreader rod 4 is surrounded by a mandrel shaft 7 which is rigidly connected to the spreading cylinder 6.

The expanding mandrel 2 is driven by a drive motor 8 with a control and computing unit 9 for maintaining a predetermined winding pull and for determining the respective outer diameter of the coil. The control and computing unit 9 includes a microprocessor 10 for determining at least the initial spreading pressure for the expanding mandrel 2 and, consequently, the spreading force to applied. In addition, the microprocessor 10 serves to determine the winding pull to be maintained in dependence upon the introduced parameters which are specific to the strips, such as, weight of the strip, specific winding pull, strip widths, strip thickness and possibly the specific weight of the strip.

The microprocessor 10 feeds the winding pull into the control and computing unit 9 and receives the outer diameter of the coil at any given time from the control and computing unit 9. As a result, the microprocessor 10 can determine the spreading pressure required at any given time for generating the necessary spreading force in dependence upon the outer diameter of the coil at any given time. With the aid of a pressure regulating valve 11 controlled by the microprocessor 10, the spreading pressure in the spreading cylinder 6 is continuously readjusted in such a way that it follows the coil diameter-dependent spreading pressure which is continuously determined by the microprocessor.

In addition, after the initial outer diameter of the coil has been introduced or determined, the microprocessor 10 determines the starting torque required for the drive motor 8 in dependence upon the specific winding pull and transmits an appropriate information to the control and computing unit 9 for the drive motor 8.

The pressure regulating valve 11 is followed in the pressure line 13 leading to the pressure cylinder 6 by a pressure-regulated spraying valve or discharge valve 12. This spraying valve 12 is connected to the return flow 14 of the pressure supply system. In addition, a multi-way valve 15 is arranged in the pressure and return line leading to the spreading cylinder 6 between the spreading cylinder 6 and the pressure regulating valve 11 or the spraying valve 12.

While a specific embodiment of the invention has been shown and described in detail to illustrate the application of the inventive principles, it will be understood that the invention may be embodied otherwise without departing from such principles.

We claim:

1. In a reel for coiling and uncoiling strips, the reel including an expanding mandrel for the coil to be received, the expanding mandrel having at least shell-like spreading members, a spreader rod and spreading elements arranged between the spreading members and the spreader rod, a spreader cylinder being connected to the spreader rod, the expanding mandrel being driven by a drive motor with a control and computer unit for maintaining a predetermined winding pull and for determining the outer diameter of the coil at any given moment, the improvement comprising the control and computing unit comprising a microprocessor for determining at least the initial spreading pressure for the expanding mandrel and the winding pull to be maintained in dependence upon introduced parameters which are specific to the strips being coiled, the microprocessor including means for introducing the winding pull into the control and computing unit and for receiving from the control and computing unit the outer diameter of the coil at any given time and for determining the spreading pressure required at any given time in dependence upon the outer diameter of the coil, a pressure regulating valve controlled by the microprocessor for continuously readjusting the spreading pressure in the spreading cylinder, such that the spreading pressure in the spreading cylinder is the same as the spreading pressure continuously determined by the microprocessor.

2. The reel according to claim 1, wherein the microprocessor comprises means for determining the starting torque for the drive motor in dependence upon the specific winding pull after introducing the initial outer diameter of the coil, and for transmitting the starting torque to the control and computing unit for the drive motor.

3. The reel according to claim 1, comprising a pressure line leading to the spreader cylinder, a pressure-controlled spraying valve being arranged in the pressure line following the pressure regulating valve.

* * * * *